United States Patent [19]

Takayama et al.

[11] Patent Number: 4,458,170

[45] Date of Patent: Jul. 3, 1984

[54] ULTRASONIC TRANSMITTER-RECEIVER

[75] Inventors: Ryoichi Takayama, Suita; Yukihiko Ise, Toyonaka, both of Japan

[73] Assignee: Matsushita Electric Industrial Co., Ltd., Kadoma, Japan

[21] Appl. No.: 328,698

[22] Filed: Dec. 8, 1981

[51] Int. Cl.[3] ..... H04R 17/00

[52] U.S. Cl. ..... 310/322; 179/110 A; 310/332; 367/140

[58] Field of Search ..... 367/163, 140; 310/324, 310/322, 331, 332; 179/110 A; 181/172

[56] References Cited

U.S. PATENT DOCUMENTS

| | | | |
|---|---|---|---|
| 2,646,853 | 7/1953 | Pocock | 181/172 |
| 3,645,356 | 2/1972 | Sotome | 181/172 |
| 3,786,202 | 1/1974 | Schafft | 179/110 A |
| 4,078,160 | 3/1978 | Bost | 179/110 A |
| 4,283,605 | 8/1981 | Nakajima | 179/110 A |

*Primary Examiner*—Richard A. Farley

*Attorney, Agent, or Firm*—Wenderoth, Lind & Ponack

[57] ABSTRACT

An ultrasonic transmitter-receiver is characterized in that a diaphragm is disposed at the center of a laminated piezo-electric element and the periphery of the diaphragm is flexibly fixed in a housing through a buffer member of elastic rubber or the like in order to suppress mechanical oscillation.

3 Claims, 14 Drawing Figures

FIG. 6
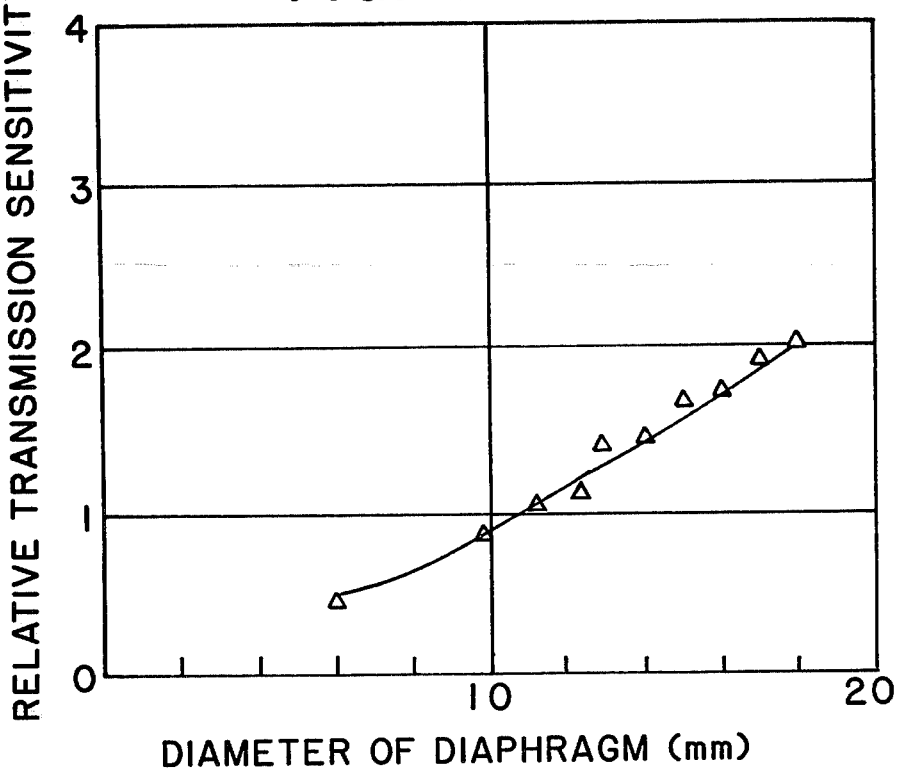
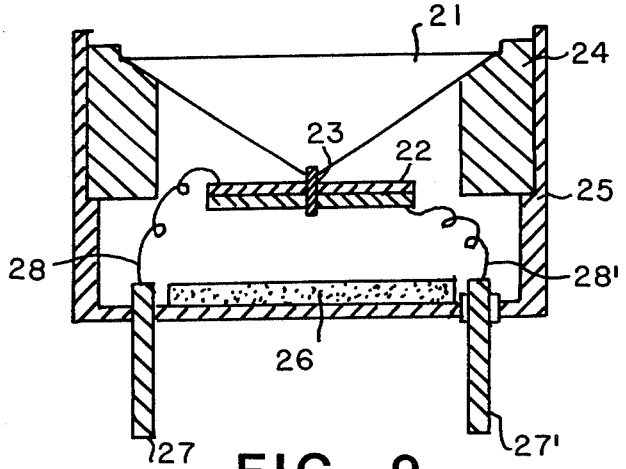
FIG. 9

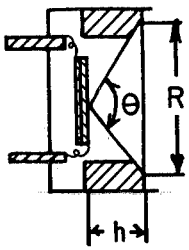
FIG. 8
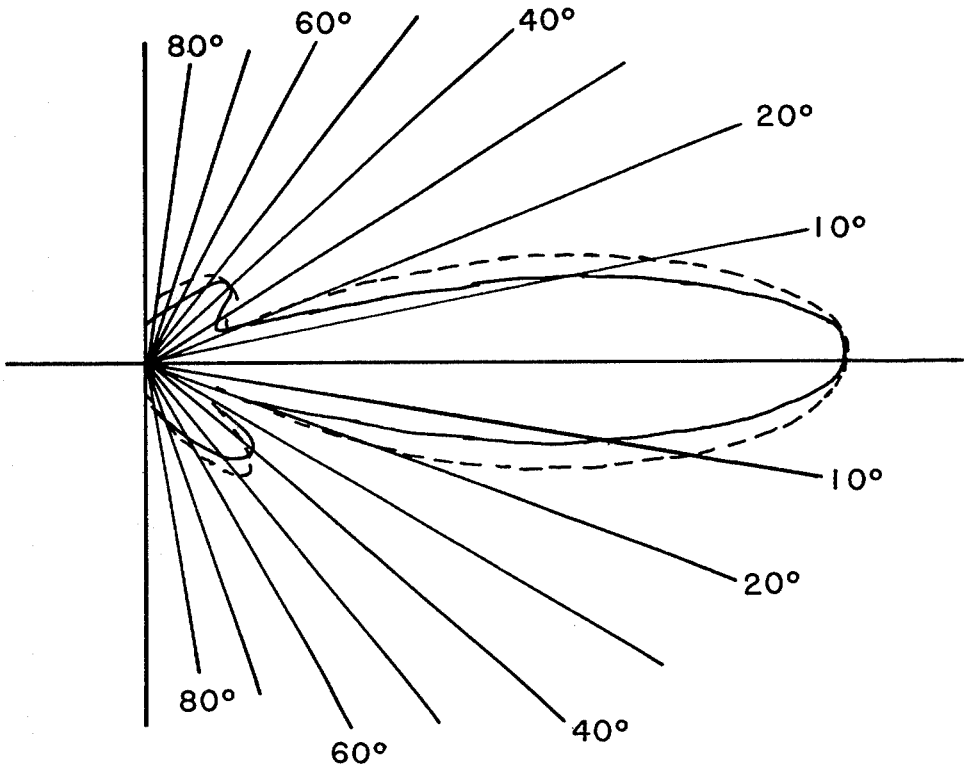

ULTRASONIC TRANSMITTER-RECEIVER

BACKGROUND OF THE INVENTION

1. Field of the Invention

This invention relates to an ultrasonic transmitter-receiver using a laminated piezo-electric element, and more particularly to an ultrasonic transmitter-receiver with improved sensitivity characteristics and improved pulse characteristics (transition characteristics).

2. Description of the Prior Art

Conventional ultrasonic transmitter-receivers used in the air usually include laminated piezo-electric ceramic elements and the laminated elements are designed to work at resonance or anit-resonance points of flexible oscillation. Further, because of the mechanical impedance of the air being substantially smaller than that of the piezo-electric ceramic element, the laminated element is bonded to a diaphragm in an attempt to reduce mechanical impedance.

Structure and operating properties of the conventional ultrasonic transmitter-receiver are illustrated in FIGS. 1 and 2.

As indicated in FIG. 1, an end of a coupling shaft 2 is fixed to pass through a central portion of a laminated piezo-electric elements 1 with the remaining end thereof being secured fixedly on a diaphragm 3. Nodes of oscillation of the laminated piezo-electric element 1 are mounted via a flexible adhesive 5 on tips of supports 4. There is further provided terminals 6 and 6', a housing 7 for protecting the laminated piezo-electric element 1 and so forth against the outside atmosphere, a protective mesh 8 disposed at a top portion of the housing 7 and lead wires 9 and 9' for connecting electrically the laminated piezo-electric element 1 to the terminals 6 and 6'.

FIG. 2 depicts the waveform of radiations transmitted when the ultrasonic transmitter-receiver of the above mentioned structure operates over a plurality of pulses, wherein rise time and fall time are relatively long, i.e. on the order of 2 milliseconds.

In the case where it is necessary to provide readouts within a short period of time through the use of the conventional ultrasonic transmitter-receiver, a particular signal is sometimes received before the preceding signal is received by the receiver because of the longer rise and fall times of the latter, thus making measurements inaccurate.

Furthermore, in the case where transmission and reception of ultrasonic radiations are performed with a single unit element, it takes a substantial amount of time to make the element ready to receive the signals after transmission of the signals. Of course, readouts are not available until the element is made ready to receive the signals.

The present invention is intended to provide a resolution to the above discussed problems.

SUMMARY OF THE INVENTION

It is a primary object of the present invention to provide an ultrasonic transmitter-receiver where the rise time and fall time of pulses are shorter.

It is another object of the present invention to provide an ultrasonic transmitter-receiver which exhibits excellent transmission sensitivity.

It is still another object of the present invention to provide an ultrasonic transmitter-receiver which exhibits excellent directivity.

Pursuant to the present invention, the above discussed problems are overcome by providing an ultrasonic transmitter-receiver wherein a diaphragm is disposed at the center of a laminated piezo-electric element and the periphery of the diaphragm for suppressing mechanical oscillation is flexibly secured on a housing by way of a buffer member made of elastic rubber or the like.

BRIEF DESCRIPTION OF THE DRAWINGS

FIG. 6 is a graph showing the relationship between the diameter of a diaphragm and the relative transmission sensitivity of the illustrated embodiment;

FIG. 8 is a graph showing the relationship between the angle of the top of the diaphragm and directivity;

FIG. 9 is a schematic view of an ultrasonic transmitter-receiver according to another embodiment of the present invention;

DETAILED DESCRIPTION OF THE PREFERRED EMBODIMENTS

Specific embodiments of the present invention will now be described by reference to the drawings.

Figure 1:
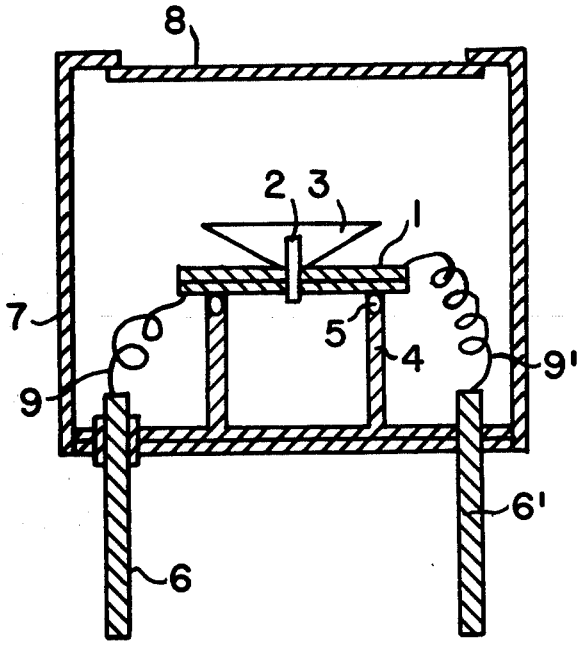
FIG. 1 PRIOR ART
FIG. 1 is a cross sectional view of a typical conventional ultrasonic transmitter-receiver.
Figure 2:
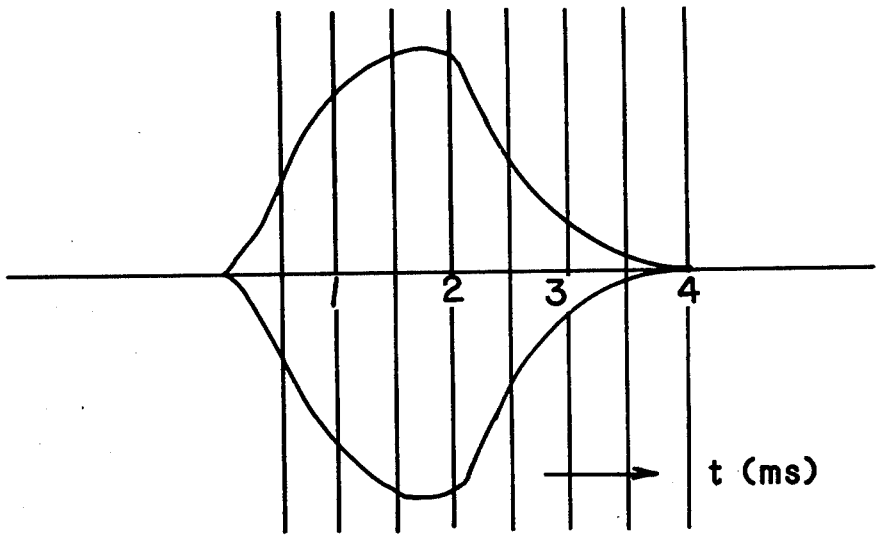
FIG. 2 PRIOR ART
FIG. 2 is a graph showing the pulse characteristics of the above illustrated transmitter-receiver.
Figure 3:
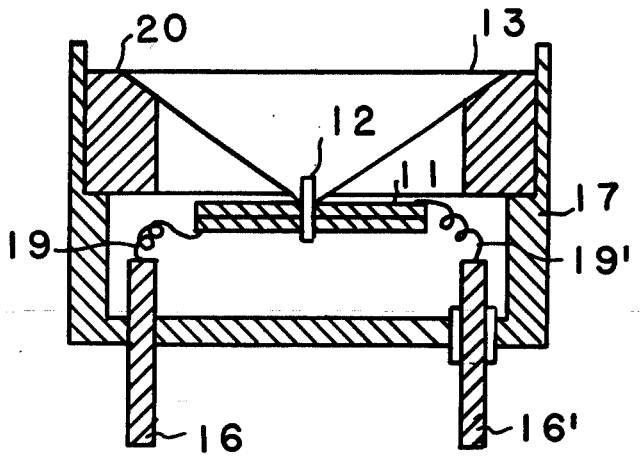
FIG. 3 is a cross sectional view illustrating an ultrasonic transmitter-receiver constructed according to an embodiment of the present invention.

FIG. 3 is a cross sectional view of an ultrasonic transmitter-receiver according to the present invention. A diaphragm 13 typically of metal or plastic is fixed around a coupling shaft 12 which is disposed at a central portion of a laminated piezo-electric element 11 made of a proper piezo-electric ceramic material. The diaphragm 13 is of a conical configuration and laminated piezo-electric element 11 is a disc configuration. A peripheral portion of the diaphragm 13 is flexibly secured in an inner side wall of a cylindrical housing 17 through the use of an annular buffer member 20 of elastic rubber or the like in order to suppress mechanical oscillation. Further, the diaphragm 13 and the laminated piezo-electric element 11 are disposed at the center of the housing 17 through the buffer member 20. A pair of terminals 16 and 16' are connected electrically to the laminated piezo-electric element 11 via lead wires 19 and 19'.

Figure 4:
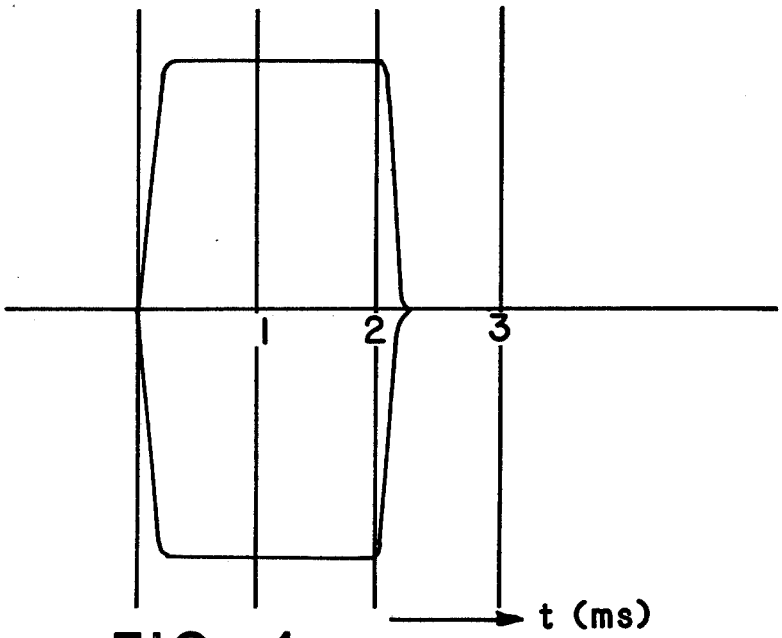
FIG. 4 is a graph showing the pulse characteristics of the above illustrated embodiment.

FIG. 4 depicts the pulse characteristics of the ultrasonic transmitter-receiver of the above described structure, indicating that the rise time and fall time of a pulse were less than 0.2 millisecond.

Figure 5:
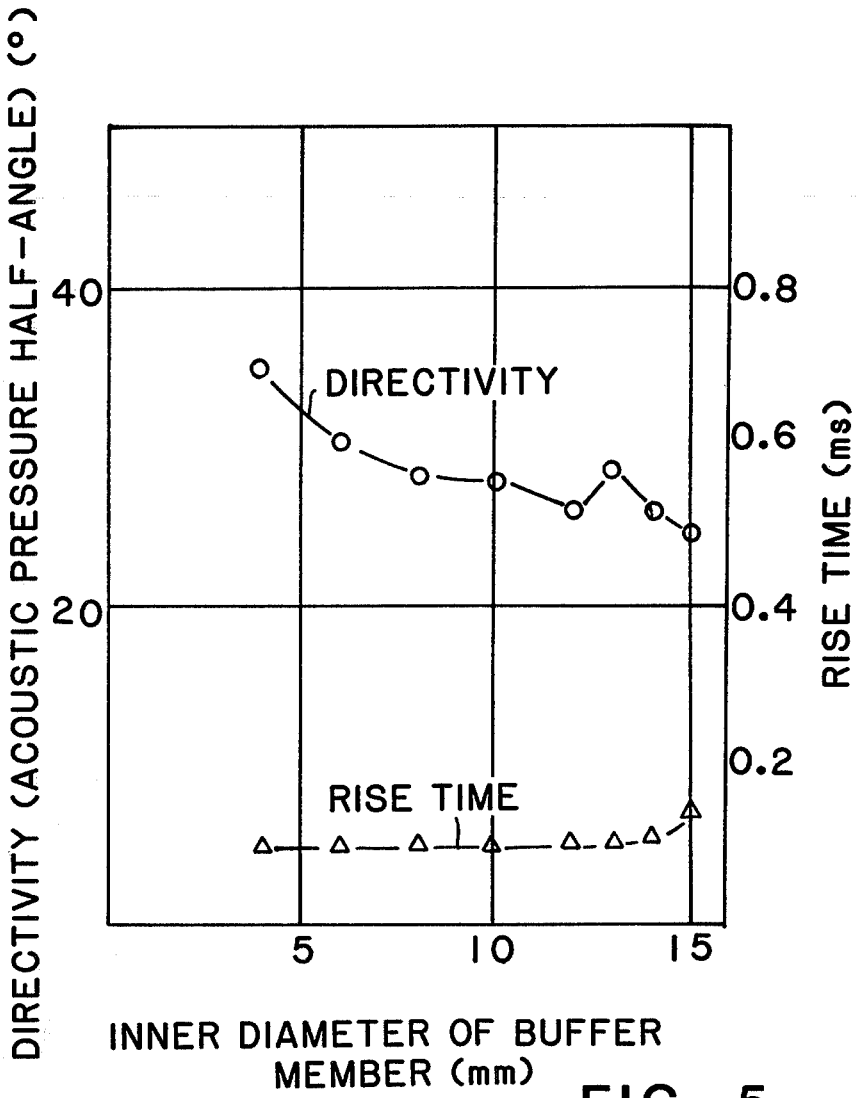
FIG. 5 is a graph showing the relationship between rise time and the inner diameter of a buffer member and the relationship between directivity (acoustic pressure half-angle) and the inner diameter of the buffer member.

FIG. 5 indicates the rise time and directivity (acoustic pressure half-angle) as a function of the inner diameter of the annular buffer member 20. In the illustrated embodiment, the diameter of the diaphragm 13 was 16 mm.

FIG. 6 is a graph showing the relationship between the diameter of the diaphragm 13 provided for the disc-like laminated piezo-electric element (diameter: 10 mm) and transmission sensitivity, indicating that the greater the diameter of the diaphragm 13 the greater transmission sensitivity.

Figure 7:
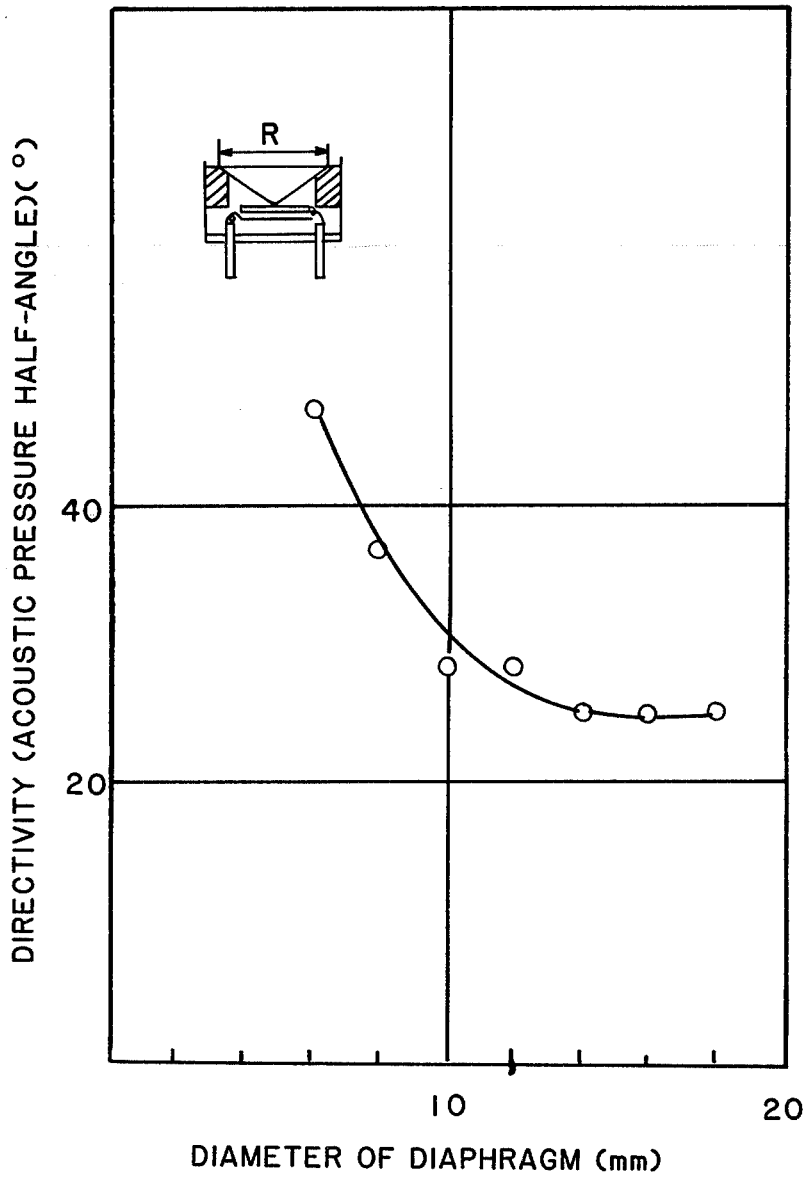
FIG. 7 is a graph showing the relationship between the diameter of the diaphragm and directivity (acoustic pressure half-angle)

FIG. 7 is a graph showing the relationship between the diameter of the diaphragm 13 and directivity (acoustic pressure half-angle). It is clear from FIG. 7 that the ultrasonic transmitter-receiver manifests acute directivity when the diameter of a diaphragm becomes greater. In addition, FIG. 8 shows the relationship between the angle of the top of the conical diaphragm 13 and directivity. The sharpest directivity was viewed when the conical diaphragm with 0.3–0.5 of height(h)-to-bottom diameter (R) ratio was used.

FIG. 9 is a cross sectional view of an ultrasonic transmitter-receiver according to another embodiment of the present invention. In FIG. 9, a diaphragm 21 typically of metal or plastic is fixed around a coupling shaft 23 which is disposed at a central portion of a laminated piezoelectric element 22 made of a piezoelectric ceramic material. A peripheral portion of the diaphragm 21 is fixedly secured in an inner side wall of a cylindrical housing 25 through the use of an annular buffer member 24 of elastic rubber or the like to suppress mechanical oscillation. In addition, an acoustic absorbent 26 is disposed at the bottom of the housing 25. A pair of terminals 27 and 27' are connected electrically to the laminated piezo-electric elements 22 via lead wires 28 and 28'.

The distinction of the ultrasonic transmitter-receiver as shown in FIG. 9 from that of FIG. 3 is the provision of the acoustic absorbent 26 at the bottom of the housing 25. The provision of the acoustic absorbent 26 assures further improvement in the pulse characteristics.

Figure 10:
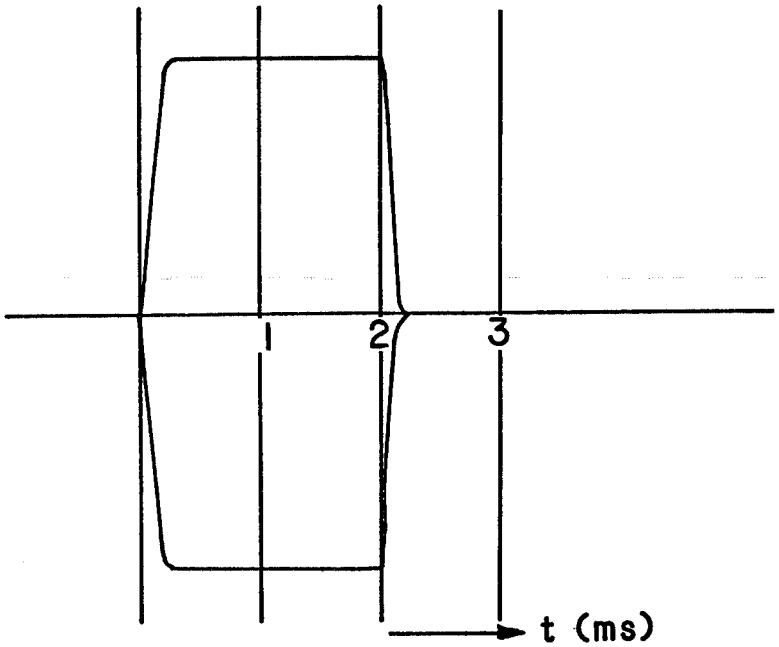
FIG. 10 is a view showing the pulse characteristics of the ultrasonic transmitter-receiver as shown in FIG. 9.

The pulse characteristics of the ultrasonic transmitter-receiver of the above detailed structure are depicted in FIG. 10, which indicates that the rise time and fall time of a pulse were shorter than 0.1 ms. It is noted that FIG. 10 was plotted with pulse envelop lines although there were in fact three to four waves before the pulse rose completely.

Figure 11:
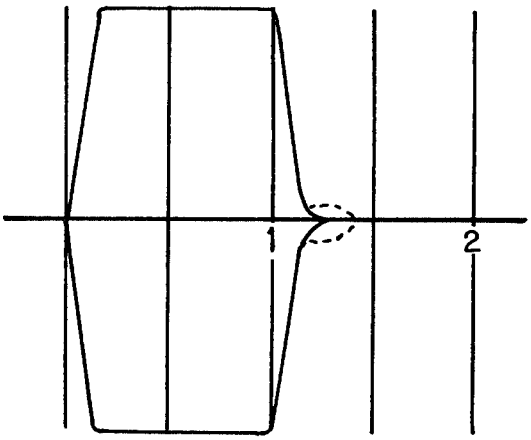
FIG. 11 is a view showing the effect of an acoustical absorbent.

FIG. 11 shows the effect of the above described acoustic absorbent 26 on the pulse characteristics, indicating a remarkable improvement in the rise time.

Figure 12:
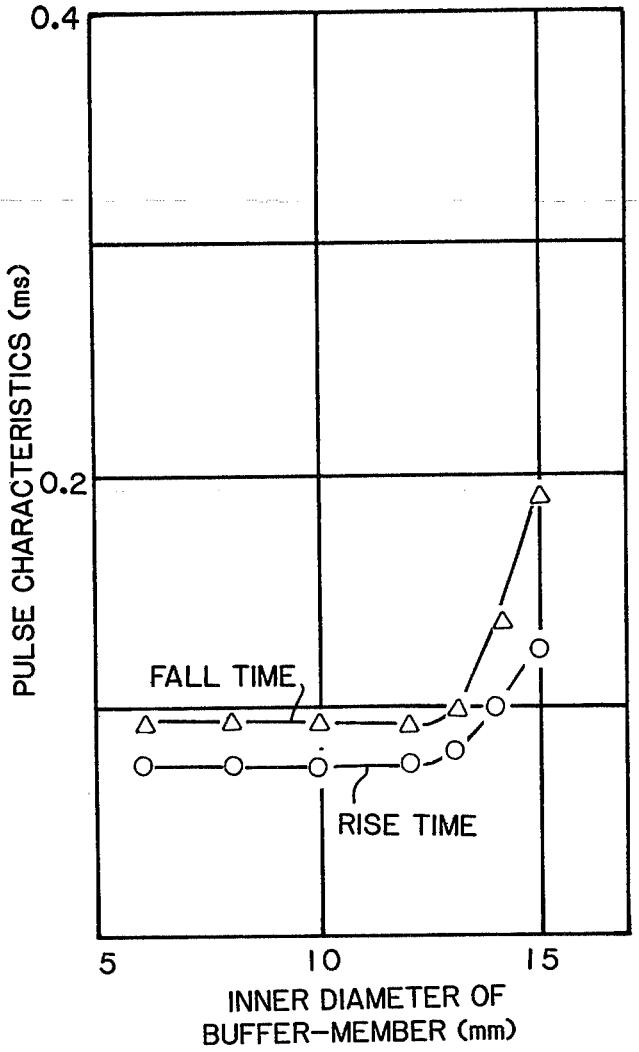
FIG. 12 is a graph showing the relationship between the inner diameter of the buffer-member and the pulse characteristics of the alternative embodiment.

FIG. 12 represents the relationship between the inner diameter of the annular buffer member 24 and the rise time and fall time. The diaphragm 21 has a diameter of 16 mm and the laminated piezo-electric elements 22 has a diameter of 10 mm and a thickness of 0.5 mm.

Figure 13:
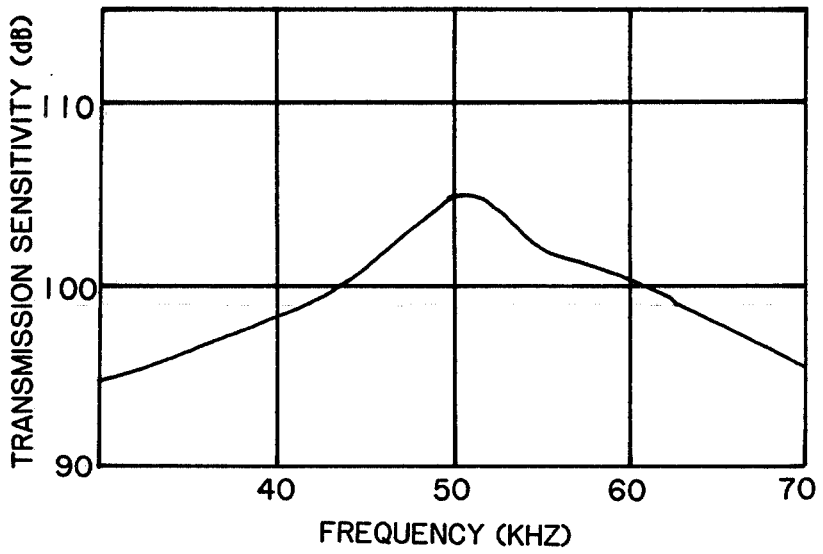
FIG. 13 is a graph showing the frequency dependency on transmission sensitivity.

In FIG. 13, there is illustrated the frequency dependency of the transmission sensitivity of the ultrasonic transmitter-receiver designed with the above exemplified dimensions according to the present invention.

Figure 14:
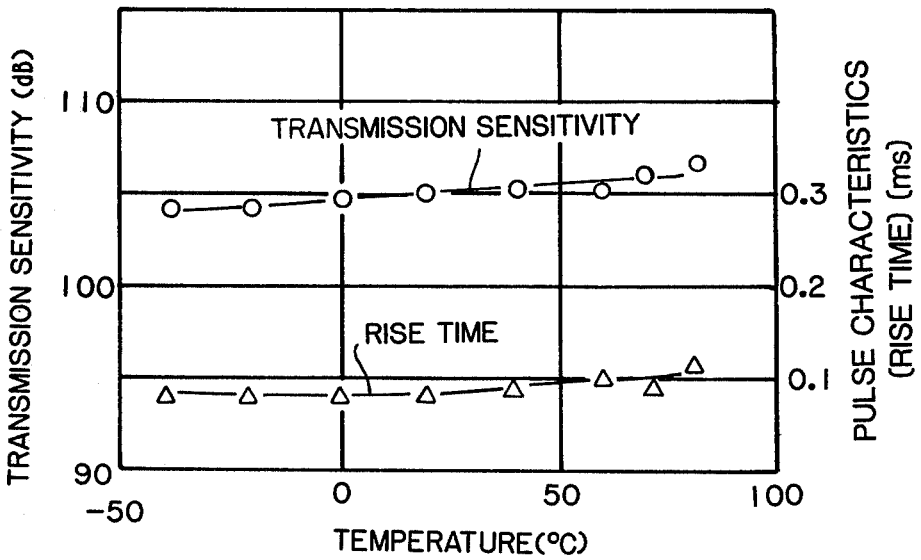
FIG. 14 is a graph showing the temperature dependency on pulse characteristics and transmission sensitivity.

FIG. 14 depicts the temperature dependency on the pulse characteristics and transmission sensitivity. As compared with those at 20° C., the rise time showed no substantial variation at −20° C. and increased by 12% at 60° C. while the transmission sensitivity declined by 5% at −20° C. and increased by 5% at 60° C. It is understood that the pulse characteristics showed no variation even when the protective mesh was disposed at the front of the housing 17.

As noted earlier, the present invention provides the ultrasonic transmitter-receiver which shows improved pulse characteristics and improved transmission sensitivity as well as the shortened pulse rise time and fall time. Furthermore, the ultrasonic transmitter-receiver embodying the present invention becomes stronger and simpler in structure with its lower profile and easier to assemble than the conventional device, by flexibly fixing and holding the diaphragm within the housing. The ultrasonic transmitter-receiver of the present invention is therefore very useful for measurements which demand readouts within a short period of time.

What is claimed is:

1. An ultrasonic transmitter-receiver comprising:

a laminated piezo-electric element, a diaphragm at a central portion of said laminated piezo-electric element, a housing means for accommodating said laminated piezo-electric element therein, an elastic buffer member disposed in bridging contact between a peripheral portion of said diaphragm and an inner side wall of said housing, wherein said diaphragm is flexibly fixed and held within said housing through the use of said elastic buffer member, and an acoustic absorbent disposed on the bottom of said housing but spaced out of contact from said laminated piezo-electric element, whereby there is an improvement in pulse characteristics, such as rise time.

2. An ultrasonic transmitter-receiver as defined in claim 1 wherein said diaphragm is of a conical configuration and said laminated piezo-electric element is of a disc configuration.

3. An ultrasonic transmitter-receiver as defined in claim 2 wherein said conical diaphragm has a ratio of height to bottom diameter within 0.3 through 0.5.

* * * * *